United States Patent [19]

Kuan-Hong

[11] Patent Number: 4,971,850

[45] Date of Patent: Nov. 20, 1990

[54] ASSEMBLED SOUND-MUFFLING THERMAL INSULATION BOARD

[76] Inventor: Lo Kuan-Hong, 8-3 Fl., No. 1, Lane 535, Minchuan E. Rd., Taipei, Taiwan

[21] Appl. No.: 405,772

[22] Filed: Sep. 11, 1989

[51] Int. Cl.[5] ..... G10K 11/04; E04B 1/99

[52] U.S. Cl. ..... 428/137; 428/119; 428/138; 428/156; 428/158; 428/167; 428/182; 428/186; 428/920; 428/921; 181/284; 181/290; 181/293; 181/292

[58] Field of Search ..... 428/119, 137, 138, 156, 428/158, 167, 182, 186, 920, 921; 181/284, 290, 293, 292

[56] References Cited

U.S. PATENT DOCUMENTS

| | | | |
|---|---|---|---|
| 2,582,144 | 1/1952 | Miles | 181/293 X |
| 2,746,892 | 5/1956 | Elfving | 428/186 |
| 3,103,255 | 9/1963 | Boschi et al. | 181/293 |
| 4,094,379 | 6/1978 | Steinberger | 181/284 |
| 4,114,725 | 9/1978 | Croasdale | 181/293 X |
| 4,226,299 | 10/1980 | Hansen | 181/284 |
| 4,475,624 | 10/1984 | Bourland, Jr. et al. | 181/292 |
| 4,531,609 | 7/1985 | Wolf et al. | 428/167 X |

FOREIGN PATENT DOCUMENTS

| | | | |
|---|---|---|---|
| 0177742 | 10/1983 | Japan | 428/186 |

*Primary Examiner*—Ellis P. Robinson
*Assistant Examiner*—William P. Watkins, III
*Attorney, Agent, or Firm*—Asian Pacific Int'l Patent and Trademark Office

[57] ABSTRACT

The present invention relates to an assembled sound-muffling thermal insulation board, and more particularly to a thermal insulation board having a surface board provided with plural pyramid bodies capable of greatly reducing the reflected sound wave going thereinto, and a sound-muffling thermal insulation layer mounted on the back face of the surface board, which is made from a styropor material and provided with plural fluffs to prevent convection of outdoor and indoor air with different temperatures whereby the hot air or cold air in an air-conditioned room will not escape and the energy is saved.

3 Claims, 5 Drawing Sheets

ASSEMBLED SOUND-MUFFLING THERMAL INSULATION BOARD

BACKGROUND OF THE INVENTION

The present invention relates to a heat-insulating board, and more particularly to an assembled sound-muffling thermal insulation board, which prevents outdoor air and indoor air with different temperatures from convective heat transfer. The board possesses a heat-insulating function and a sound-muffling function. Sound waves entering a muffling chamber a fluffy surface to thereby minimize sound wave reflections. Very little sound wave can directly reflect back; most sound waves are reduced or eliminated.

The conventional sound-muffling thermal insulation board is commonly made from celotax board which is drilled with beehive holes. This kind of structure can not throughly achieve the noise-reducing effect. The noise problem has become a publicly concerned problem and has been deemed a major source of environmental pollution.

The heat-conduction coefficients of general construction materials are as follows:

reinforced concrete: 1.5
lumber: 0.15
lumber gore plywood(5cm): 0.07
cork plywood: 0.035
Styropor(fibrous fluffy mat material): 0.035

With reference to the above data, the applicant employs a construction material with extremely low heat-conduction coefficient to manufacture the thermal insulation board. Moreover, with his experience in many years wireless communication working, the applicant knows well that the electromagnetic wave is reflected between the earth surface and stratus, and if the earth surface appears to be plane land or sea surface, the electromagnetic signal can be clearly received. However, if the electromagnetic wave is reflected by a grassland, the signal will be greatly weakened and can be hardly received. Similarly, the same phenomenon occurs in the sound wave. Therefore, by means of plural pyramid surfaces, the sound wave can be reflected into sound-muffling holes and then into sound-muffling chamber and impact plural fluffs formed on a sound-muffling layer and therefore be muffled by the fluffs.

Accordingly, the applicant has developed the assembled sound-muffling thermal insulation board of the present invention to eliminate shortcomings existing in prior art.

SUMMARY OF THE INVENTION

It is a primary object of the present invention to provide an assembled sound-muffling thermal insulation board having a surface board formed with multiple pyramid bodies whereby sound wave will directly enter or reflect once into or reflect twice into the sound-muffling chamber, to reduce therefore noise pollution.

It is a further object of the present invention to provide the above thermal insulation board having a sound-muffling thermal insulation layer provided with plural fluffs which are impacted by sound waves to weaken the reflection thereof. Only little weakened sound wave can reflect outward; the remainder of the wave is continuously weakened and finally eliminated.

It is still a further object of the present invention to provide the above thermal insulation board wherein the sound-muffling thermal insulation layer is made from a fibrous fluffy material (Styropor), which can perform thermal insulation and sound muffling functions to save energy.

BRIEF DESCRIPTION OF THE DRAWINGS

The present invention can be best understood through the following description and accompanying drawings wherein.

DETAILED DESCRIPTION OF THE PREFERRED EMBODIMENTS

Figure 1:
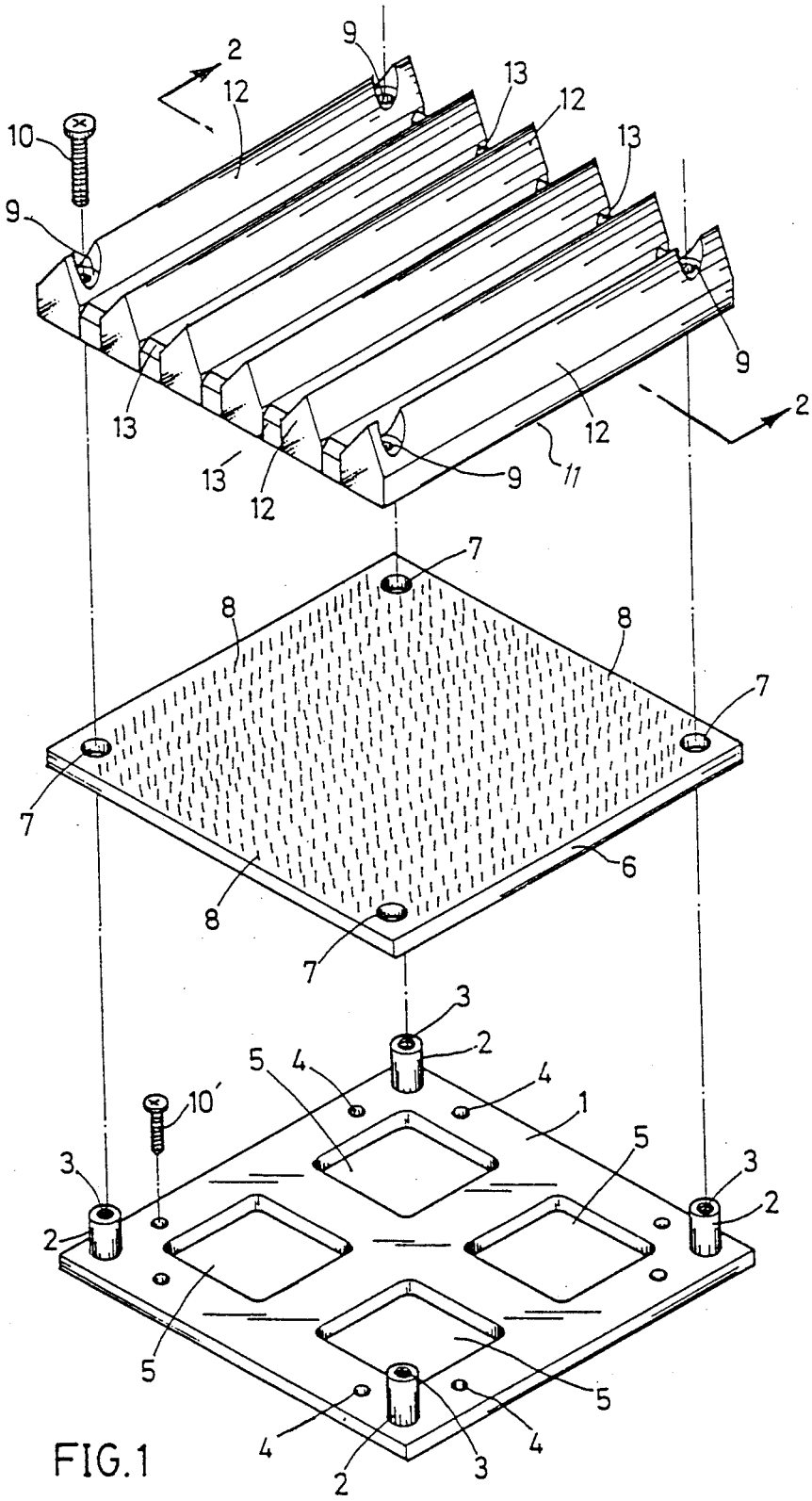
FIG. 1 is a perspective exploded view of the present invention.
Figure 2:
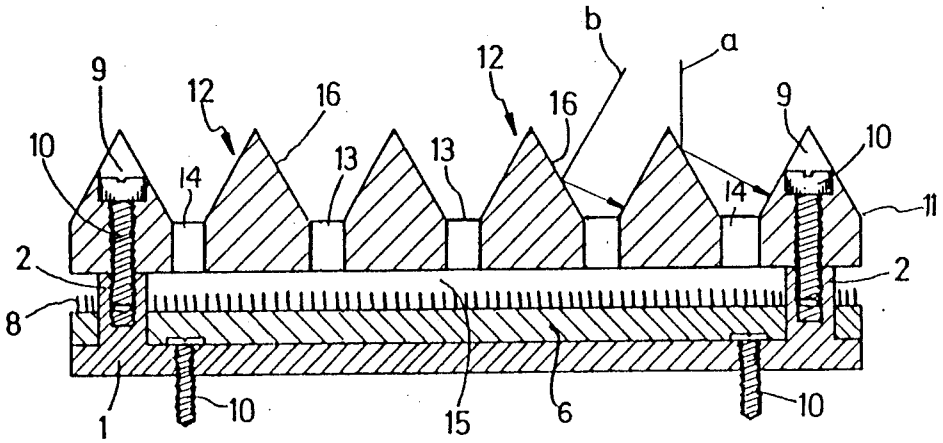
FIG. 2 is a sectional view taken on line 2—2 in FIG. 1.
Figure 3:
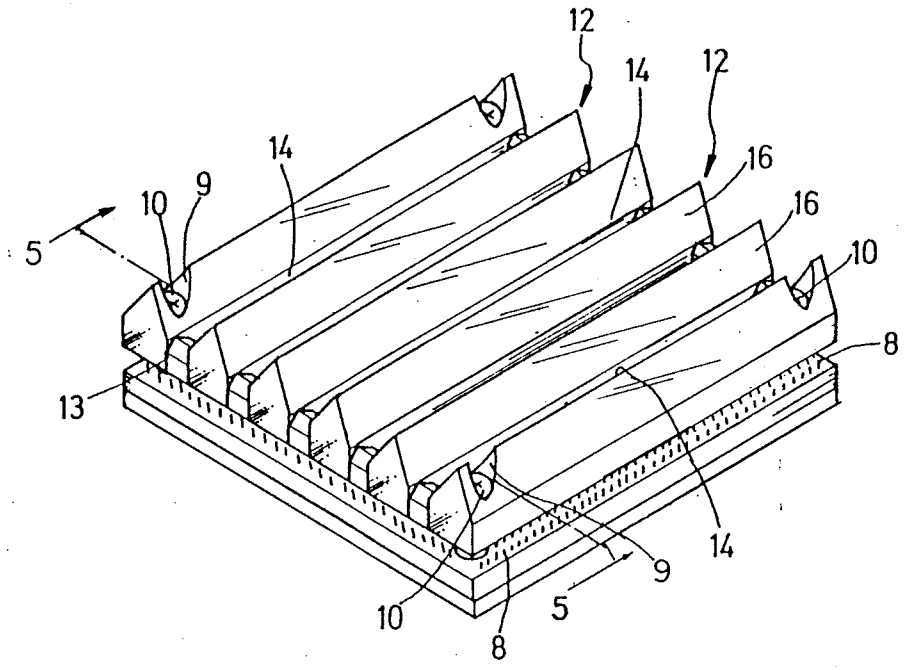
FIG. 3 is a perspective assembled view of the present invention.
Figure 4:
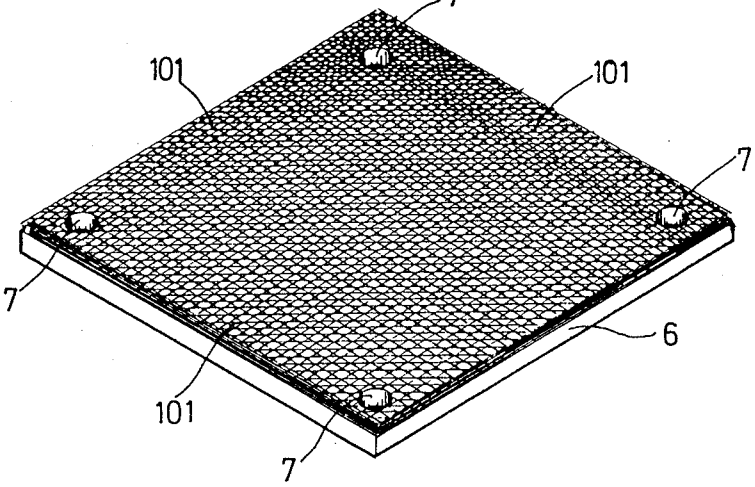
FIG. 4 shows another embodiment of the sound-muffling thermal insulation layer thereof.
Figure 5:
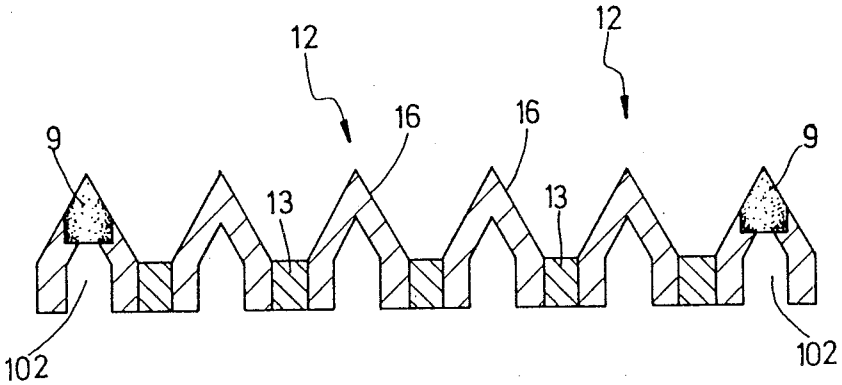
FIG. 5 is sectional view of another embodiment of the surface board thereof.

Please refer to FIGS. 1-3. The present invention includes a base board 1, four corners of which are provided with four cylinder supports or spacers 2, each formed with a female thread hole 3, a sound-muffling thermal insulation layer 6 having four fixing holes 7 and made from a fibrous fluffy mat material (Styropor) and provided with plural fluffs 8 or irregular network 101 as shown in FIG. 4 to prevent thermal conduction and convection of outdoor and indoor air with different temperatures for saving energy, and a surface board 11, four corners of which are formed with four female thread holes 9 and provided with plural solid pyramid bodies 12 or hollow pyramid bodies 102, as shown in FIG. 5, and pyramid connectors with forty five degrees vertex angles. The pyramid bodies 12 are evenly spaced form one another at a proper distance to form plural sound-muffling holes 14; the surface board 11 matches with the thermal insulation layer 6 to form a sound-muffling chamber 15. As shown in FIG. 1, pyramid bodies 12 take the form of triangular cross sectional ribs extending linearly along the board surface. As seen in FIG. 2, each rib triangle section is an isosceles triangle arranged with the base of the triangle extending parallel to the general plane of board 11. Thin cross strips 13 at the ends of ribs 12 act as spacer devices to form openings 14.

The base board 1 is further formed with thread holes 4 into which screws 10' can be screwed to fix the base board 1 to a wall or a ceiling. Alternatively, glue can be applied to the back face of the base board 1 to attach the same to a wall. Moreover, to save material and reduce weight of the base board 1, four square holes 5 are formed thereon. The thermal insulation layer 6 is mounted on the base board 1 with the four supports 2 thereof inserted into its four fixing holes 7. The surface board 11 can be then connected to the thermal insulation layer 6 by means of screwing screws 10 into its four female thread holes 9 and into the female thread holes 3 of the supports 2 of the base board 1 to therefore form an assembled sound-muffling thermal insulation board.

According to the above arrangement, when a sound wave goes toward the thermal insulation board at a ninety degree angle thereto, it will meet the inclines 16 of the pyramid bodies 12 at an 22.5 incidence angle, as indicated by arrow A. In this case, all sound wave will directly go or reflect once into the sound-muffling holes 14. If sound wave goes toward the thermal insulation board at a 112.5 angle, as indicated by arrow B, then the sound wave will go directly or reflect once of twice into the sound-muffling holes 14. When the rest sound wave impacts the fluffs or irregular network of the sound-muffling thermal insulation layer, the sound wave will by largely absorbed and weakened due to the irregularity and softness of the fluffs. Even if little weak sound wave is reflected through the sound-muffling holes 14, because the sound-muffling hole 14 is smaller than the bottom face of the pyramid body 12, the reflected sound wave will be weakened.

What is claimed is:

1. An assembled sound-muffling thermal insulation board, comprising:

a base board (1) having means thereon for fastening said baseboard to a wall or ceiling;

a sound-muffling thermal insulation layer (6) secured to said base board, said thermal insulation layer having a fibrous fluffy surface facing away from the base board;

said base board having spacer means (2) thereon extending through the thermal insulation layer; and a surface board having one face thereof engaged with said spacer means in spaced relation to the fibrous fluffy surface of the thermal insulation layer;

said surface board comprising a series of evenly spaced triangular cross-sectioned ribs (12) extending therealong; each rib triangle section being an isosceles triangle arranged with the base of the triangle extending parallel to the general plane of the surface board; the spacing between the triangular cross sectioned ribs being substantially less than the base dimension of each triangle.

2. The thermal insulation board of claim 1, wherein each triangular cross-sectioned rib is hollow.

3. The thermal insulation board of claim 2, wherein the vertex angle of each rib triangle section is approximately forty five degrees.

* * * * *